US005186425A

United States Patent [19]

Keusch et al.

[11] Patent Number: 5,186,425

[45] Date of Patent: Feb. 16, 1993

[54] TABLE SUPPORT FOR A WORK TABLE OR OFFICE DESK

[75] Inventors: Siegfried Keusch, Plochingen; Daniel Korb, Sindelfingen, both of Fed. Rep. of Germany

[73] Assignee: Dyes GmbH Buromobelfabrik, Fed. Rep. of Germany

[21] Appl. No.: 755,369

[22] Filed: Sep. 6, 1991

[30] Foreign Application Priority Data

Sep. 7, 1990 [DE] Fed. Rep. of Germany ..... 4028452

[51] Int. Cl.[5] ..... A47B 35/00

[52] U.S. Cl. ..... 248/188.1; 248/188; 108/157; 108/50; 312/223.6

[58] Field of Search ..... 248/188.1, 188.7, 188; 108/157, 50, 60, 4; 312/223.6, 107, 265.6, 351.1

[56] References Cited

U.S. PATENT DOCUMENTS

| | | | |
|---|---|---|---|
| 4,323,291 | 4/1982 | Ball | 312/223.6 X |
| 4,879,955 | 11/1989 | Moll et al. | 108/50 |
| 5,083,512 | 1/1992 | Newlocese et al. | 108/50 |
| 5,086,710 | 2/1992 | Korb . | |

FOREIGN PATENT DOCUMENTS 0123972 9/1984 European Pat. Off. .

*Primary Examiner*—Alvin C. Chin-Shue
*Attorney, Agent, or Firm*—Speckman & Pauley

[57] ABSTRACT

A table support for a work table or office desk having two lateral table legs, the upper ends of which are rigidly connected with each other with a cross piece and the lower ends of which have foot elements oriented towards the front and back of the work table or office desk. A simple structure with many add-on capabilities is achieved since the cross piece is formed by a tub-shaped sheet metal section which is open at the top, and the side walls of which are shaped as hollow sections. The side walls have connecting sections for fixing a cable channel cover on their interior side, facing each other. Connecting straps are inserted into both ends of the sheet metal section which, along with the side walls of sheet metal section and together with the base leg of the sheet metal section, are rigidly connected with the table legs. Insertion connectors are inserted into the ends of the side walls, which are formed as hollow sections, of the sheet metal section. The insertion connectors are accessible at the front and through cutouts in the side walls for the purpose of fastening additional attachable devices.

21 Claims, 4 Drawing Sheets

TABLE SUPPORT FOR A WORK TABLE OR OFFICE DESK

BACKGROUND OF THE INVENTION

1. Field of the Invention

This invention relates to a table support for a work table or office desk having two lateral table legs, the upper ends of which are rigidly connected with each other with connecting straps and a cross piece. The lower ends of the two lateral table legs have foot elements oriented towards the front and back of the work table or office desk. A cross piece is shaped like a tub and is open towards the top and also has side walls in the form of hollow sections. The cross piece can be closed off with a cable channel cover, and additional devices can be attached to the cross piece.

2. Description of Prior Art

A table support of this type is known from European patent publication EP-A2 0 123 972. A cross piece is assembled from a base section of a U-shaped track section and two lateral hollow sections. The table legs are connected directly to the connecting straps, with which the base section and the lateral hollow sections are connected. The lateral hollow sections are in the form of rectangular sections placed on edge, the horizontal narrow sides of which have continuous longitudinal grooves. It is thus possible to attach additional devices to the lateral hollow sections with clamp-like fasteners.

This known table support requires three sections for forming the cross piece, which must be connected to each other, in particular welded together. For this reason the cross piece is very complex and expensive. The connecting straps are also complex and expensive, and are in the form of cast parts which are used as connecting elements for an additional cross piece.

SUMMARY OF THE INVENTION

It is one object of this invention to provide a table support of the previously mentioned type, which can be assembled from a few parts manufactured in a simple and cost-effective way with minimal assembly effort and which does not hinder the attachment of additional devices on the front or the sides of a cross piece.

The above object is achieved according to one embodiment of this invention with the cross piece, having the side walls, being constructed or formed as a sheet metal section. Connecting straps are inserted into the receptacles of the sheet metal section at both ends, which are connected with the sheet metal section and the table legs. Insertion connectors are pushed into the ends of the hollow-sectional side walls of the sheet metal section, which have fastening receivers for attaching the additional devices in their fronts and, through cutouts, in the side walls of the sheet metal section.

The cross piece is a simple deformable sheet metal part, yet it has sufficient stability because of its side walls formed as hollow sections. The connecting pieces are simple parts which assure sufficient strength in the area of the nodes between the cross piece and the table legs. The insertion connectors are pushed or inserted into the hollow sections, thereby providing for attachment of additional devices towards the front of the table, the back of the table and the top of the table. It is also possible to provide a simple add-on connection with adjacent similar work tables or office desks and other additional devices by way of the fronts of the insertion connectors. In this way, the table support according to this invention fulfills all requirements of a modern work table or office desk. The cross piece, in connection with the cable channel cover, also contains an easily accessible cable channel.

In accordance with one embodiment of this invention, the hollow sections of the side walls of the sheet metal section have a semi-hollow cylindrical cross section, where the base legs of the sheet metal section merge into convexly curved exterior sections and then into straight, vertical interior sections. This shape of the cross piece is aesthetically pleasant.

In another embodiment of this invention, manufacture of the cross piece includes the sheet metal section being bent or formed from a sheet metal blank, where the vertical interior sections pass over into horizontal fastening sections which are rigidly connected with the base leg, for example, by welding.

The simple and removable connection between the sheet metal section and the cable channel cover is accomplished by having the passages of the convexly curved exterior sections of the side walls of the sheet metal section merge into the straight, vertical interior sections through a set-off, horizontal connecting section. The cable channel cover is lockingly supported and maintained in the connecting sections with bent, longitudinally directed spring pins.

According to still another embodiment of this invention, the cable channel cover is in the form of a lid which flushly covers or closes off the open side of the sheet metal section.

The capacity of the cable channel is increased in a simple manner since the cable channel cover has a U-shaped cross section with spreading side legs and since at least one of the side legs has an integral continuous gripping groove.

If the table legs are constructed or formed as hollow sections, each having an essentially rectangular cross section, and the base legs of the sheet metal section and the connecting straps above the hollow sections of the table legs have cutouts, it is possible to use the table legs to route electrical cables which can be easily inserted into the cross piece.

The table legs can be used for applying further additional devices since the walls of the narrow sides extend beyond the walls of the broad sides, of the hollow sections used as table legs, to form connecting bars. A cable channel cover can be fixed between each one of the connecting bars of a wall of the broad sides.

The stability in the area of the nodes between the cross piece and the table legs is improved since the cross sections of the insertion connectors are adapted to the cross sections of the side walls in the shape of hollow profiles of the sheet metal sections, and the cross sections have a continuous bore or threaded bore. This bore or threaded bore is used for the simple connection of additional add-on furniture. Thus, it is also possible for the threaded bores to be threaded blind bores in the fronts of the insertion connectors, which permits simple threaded connections at the front ends of the cross piece.

Additions are accommodated in the area of the longitudinal edges of the cross piece since the insertion connectors, oriented towards the convexly curved exterior sections of the side walls of the sheet metal section, are divided into connecting bars positioned by means of cutouts in a preset grid formation. Additional devices, such as support arms or supports, can be connected with these connecting bars through the convexly curved exterior sections of the side walls, for example by a threaded connection.

Since the connecting bars extend over almost 180°, this angle sector is also available for adding on other devices. It should be kept in mind that the angle sectors at both convex exterior sections of the cross piece adjoin each other.

If the work table or office desk is used as a stand-alone unit, then according to another embodiment of this invention, the front sides of the cross piece are covered by closure elements.

In another preferred embodiment of this invention, the cross piece extends by a predetermined distance beyond the table legs which are in the form of hollow sections, in order to achieve a sufficient distance between the table legs of adjoining work tables or office desks when similar work tables or office desks are placed in a row.

This invention will be described in more detail by means of a preferred embodiment shown in the drawings.

DESCRIPTION OF PREFERRED EMBODIMENTS

Figure 1:
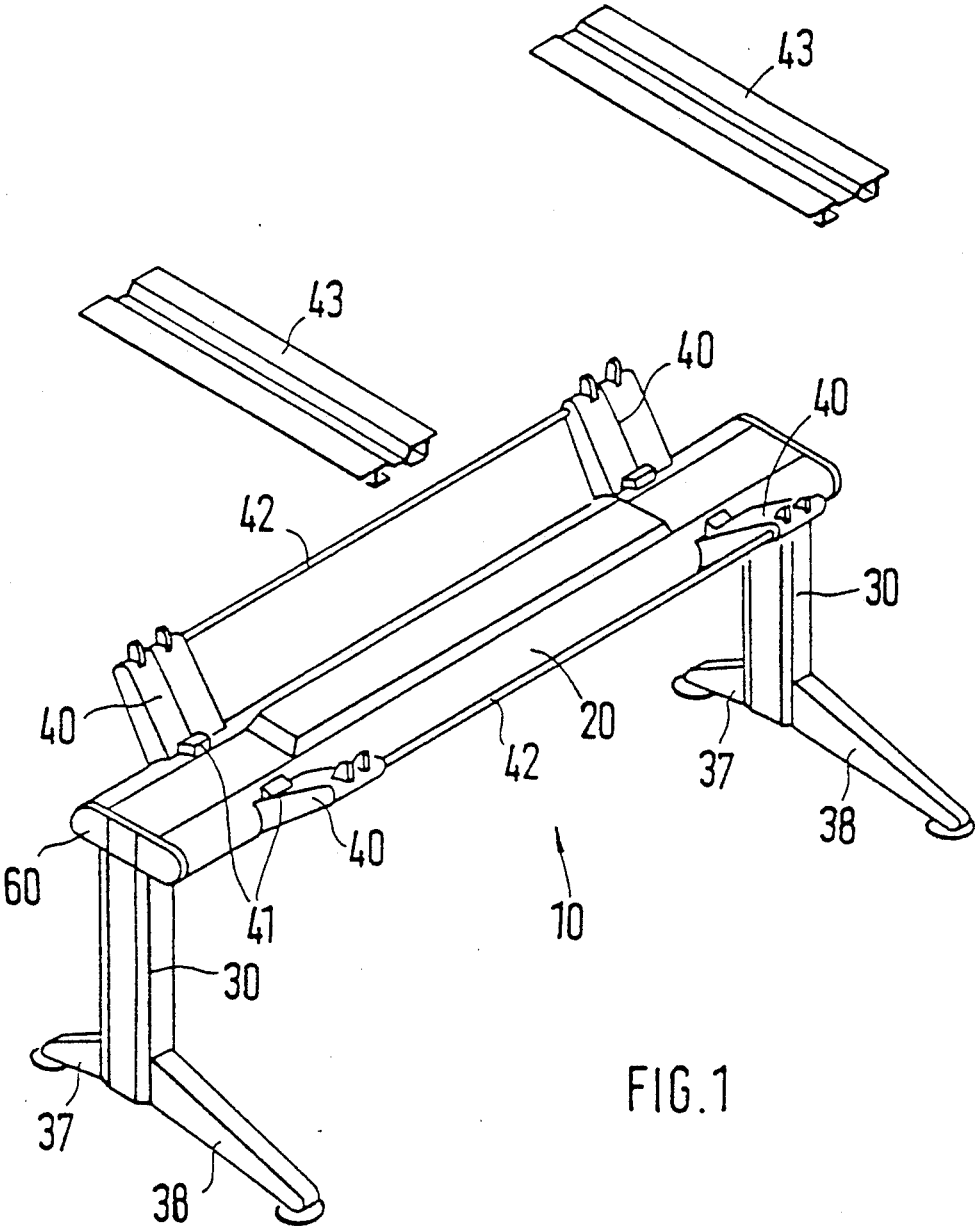
FIG. 1 is a perspective view of a table support in accordance with one embodiment of this invention.

The perspective view of FIG. 1 shows the table support of a work table or office desk having two lateral table legs 30, in addition to a cross piece 20. The bottom ends of the table legs 30 have short foot elements 37 towards the back of the work table or office desk, and towards the front have relatively long foot elements 38. The cross piece 20 is rigidly connected with the top ends of the table legs 30. The guide elements 41 for the four pivotal support arms 40 are positioned on longitudinal edges of the cross piece 20. Depending on the position of the support arms 40, the height and/or inclination of the work surface, not shown, can be changed. For this purpose, the free ends of the support arms 40 are fixed on sliders which are adjustable on guide rails 43. These guide rails 43 are fastened to the underside of the work surface and typically extend from the front to the back of the work surface. The adjustment mechanism of the support arms 40 only needs to be addressed within the context of this invention to the extent required to explain the hinging relationship of the support arms 40 with respect to the cross piece 20. The support arms 40 are in this case coupled in pairs by coupling bars 42, so that they are pivoted together in pairs and in the same direction on the front and/or the back of the work table or office desk. In such embodiment, the drive for the support arms 40 can also be integrated in them. If the work table or office desk is a stand-alone unit, the front faces of the cross piece 20 are covered by closure elements 60.

Figure 2:
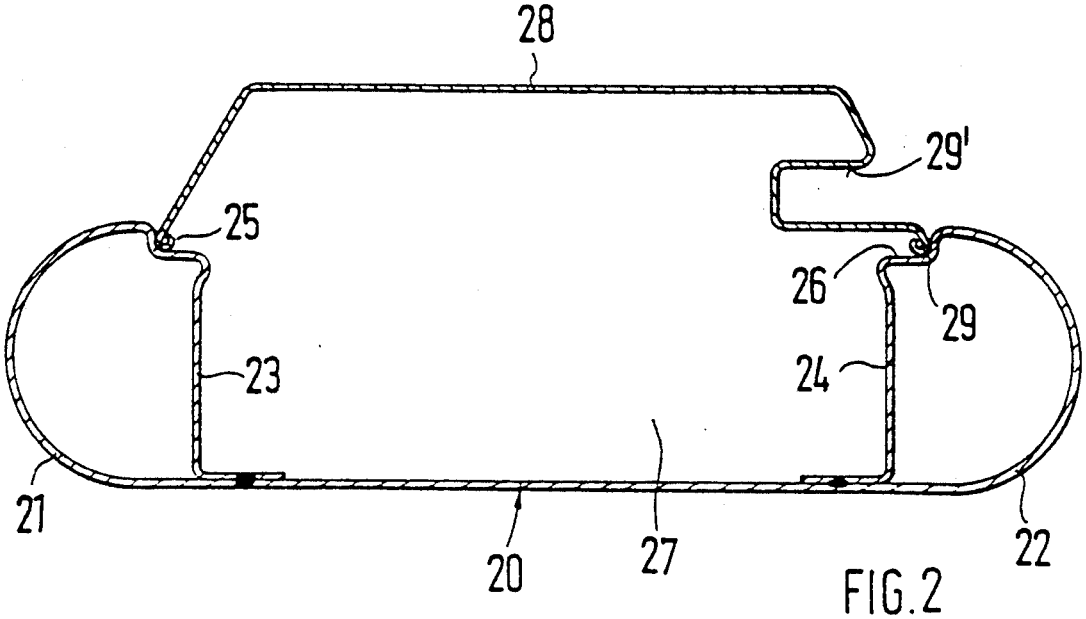
FIG. 2 is a cross-sectional view of a sheet metal section with a cable channel cover.
Figure 6:
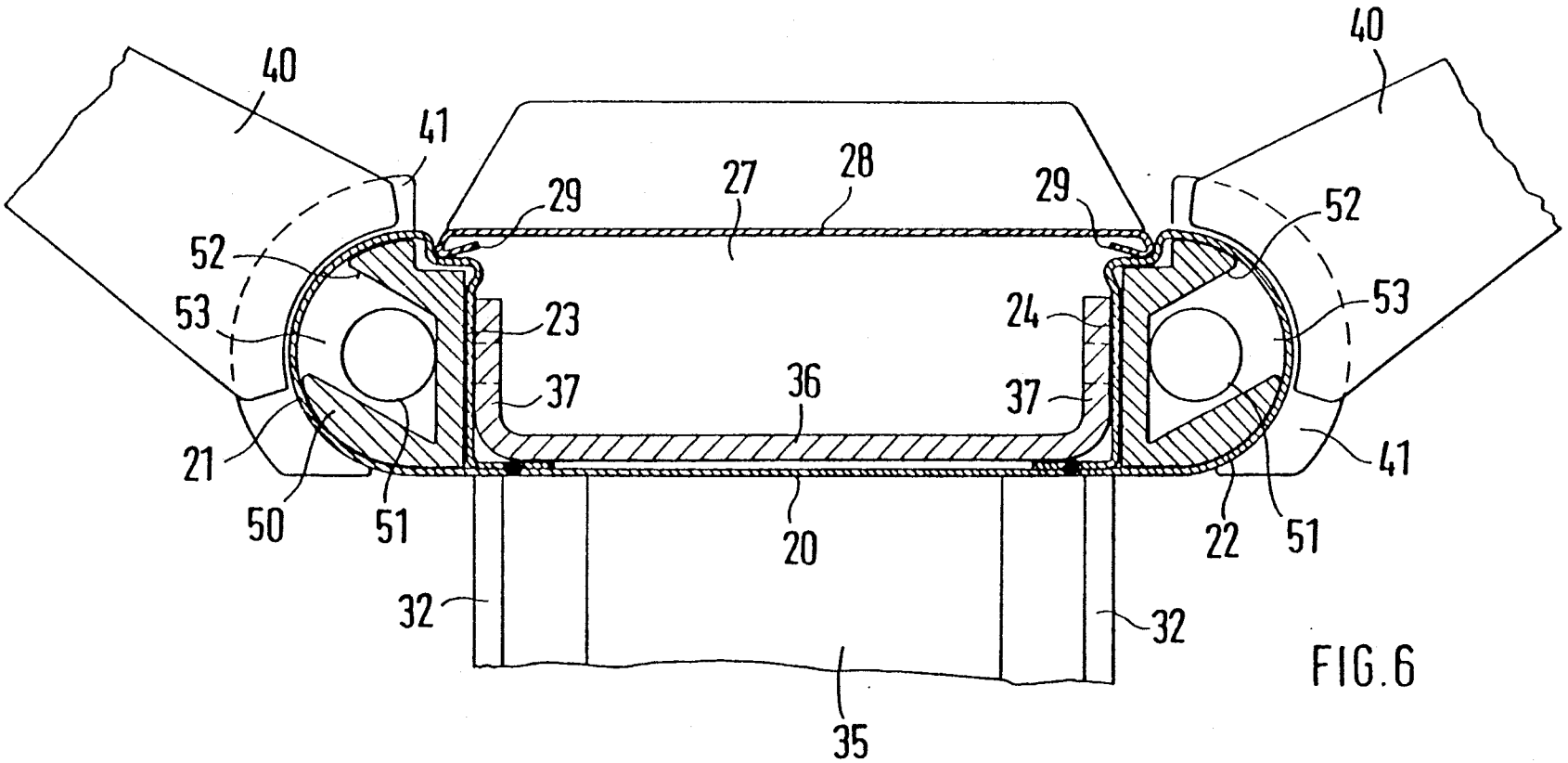
FIG. 6 is a cross-sectional view in an area of nodes of the cross piece, sheet metal section and table leg, where insertion connectors are used for the hinged connection of support arms for the work surface.

The basic element of the cross piece, the sheet metal section 20, is shown in FIG. 2. The side walls of the tub-shaped sheet metal section 20 themselves are constructed as hollow sections. In the embodiment shown in FIG. 2, these hollow sections form a somewhat semi-hollow cylinder together with the convexly curved exterior sections 21 and 22 and the straight, vertical interior sections 23 and 24, and thus provide sufficient stability to the sheet metal section 20. The sheet metal section 20 is bent from a sheet metal blank. The straight, vertical interior sections 23 and 24 merge into horizontal fastening sections, which are rigidly connected, for example by welding, with the base leg of the sheet metal section 20. The cable channel cover 28, the lateral legs of which spread in the direction of the free ends and end in spring pins 29, is used to cover or close off the open side of the sheet metal section 20. The spring pins 29 lock into the horizontal connecting sections 25 and 26 of the sheet metal section 20. Spring pins 29 are set off at the transition from the convexly curved exterior sections 21 and 22 to the straight, vertical interior sections 23 and 24, so that the spring pins 29 can lock in them. The cable channel cover 28 completes the cable channel 27 with a large cross section. As shown by FIG. 6, the cable channel cover 28 may also flushly close off the open side of the sheet metal section 20.

Figure 3:
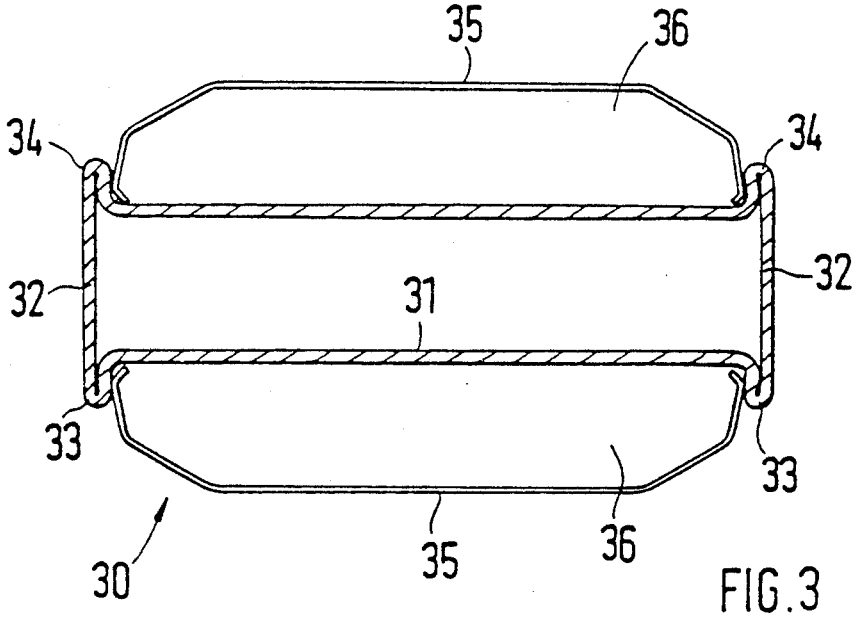
FIG. 3 is a cross-sectional view of a table leg constructed of a hollow section, and two cable channel covers.

The cross section of the table legs 30 is shown in FIG. 3. The table leg 30 comprises the hollow section 31 having an essentially rectangular cross section. The walls 32 of the narrow sides of the hollow section 31 have been extended beyond the walls of the broad side of the hollow section 31 to form connecting bars 33 and 34. The cable channel cover 35 can be locked between the connecting bars 33 and 34 of a wall of the broad side. In such embodiment, the connecting bars 33 and 34 have slight undercuts into which the engagement bars formed on the cable channel cover 35 can be seated. In this manner, cable channels 36 are formed on both walls of the broad side of the hollow section 31, which are easily accessible by removal of the cable channel covers 35.

As shown in FIG. 6, a connecting strap 36 is employed on both ends of the sheet metal section 20. The lateral legs 37 of the connecting straps 36 are rigidly connected, for example with screws, with the straight, vertical interior sections 23 and 24 of the side walls of the tub-shaped sheet metal section 20. The center leg of the connecting strap 36, together with the base leg of the sheet metal section 20, is connected with hollow section 31 of the table leg 30, for example by a welded connection or by a screwed connection. In this way, the node between the cross piece and the table leg has sufficient stability.

Insertion connectors 50, the cross section of which is adapted to the cross section of the hollow sections, are inserted into the hollow sections of the side walls of the sheet metal section 20. These insertion connectors 50 can have a continuous bore 51 or a threaded bore, which may also be a threaded blind bore on the front face. It is thus possible to connect other work tables or office desks as well as other additional devices on the front face. If these connections are not used, the front faces are closed off with the closure elements 60, as shown in FIG. 1. In this embodiment, the bores 51 or the threaded bores in the insertion connectors 50 can be used.

The insertion connectors 50 are divided into connecting bars 53 in the longitudinal direction by means of cutouts 52 in a preset pattern, which closely fit against the concave interiors of the convexly curved exterior sections 21 and 22 of the hollow sections of the sheet metal section 20. It is possible to thread additional devices directly to the insertion connectors 50 by means of threaded connections, in which case screws extend through the convexly curved exterior sections 21 and 22 and are rotated into the threaded bores of the connecting bars 54. It is possible, for example, to fasten the dove-tailed guide element 41 in the shape of an arc in this manner, on which the support arm 40 is pivotal in a limited way with a corresponding dove-tailed groove in the shape of an arc.

It is also possible to insert additional devices through cutouts in the convexly curved exterior sections 21 and 22 in the cutouts 52 of the insertion connectors 50 and to secure them there with a bolt introduced into the bore 51.

Figure 4:
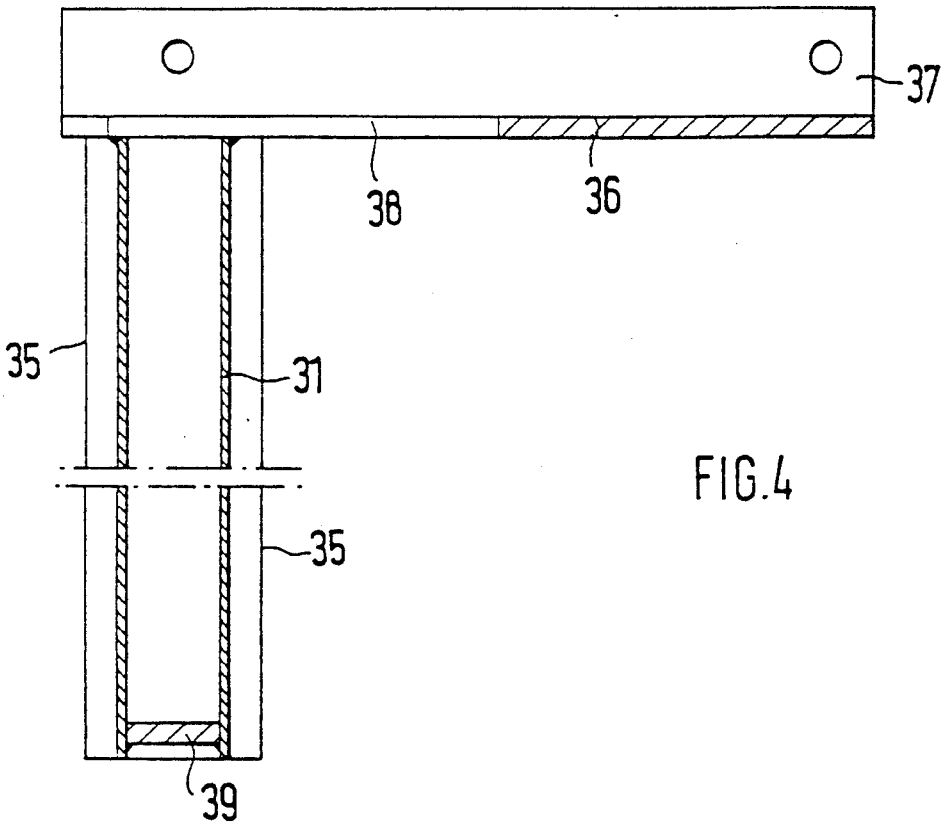
FIG. 4 is a schematic view of a unit formed of a table leg and connecting strap, into which a cross piece is inserted.
Figure 5:
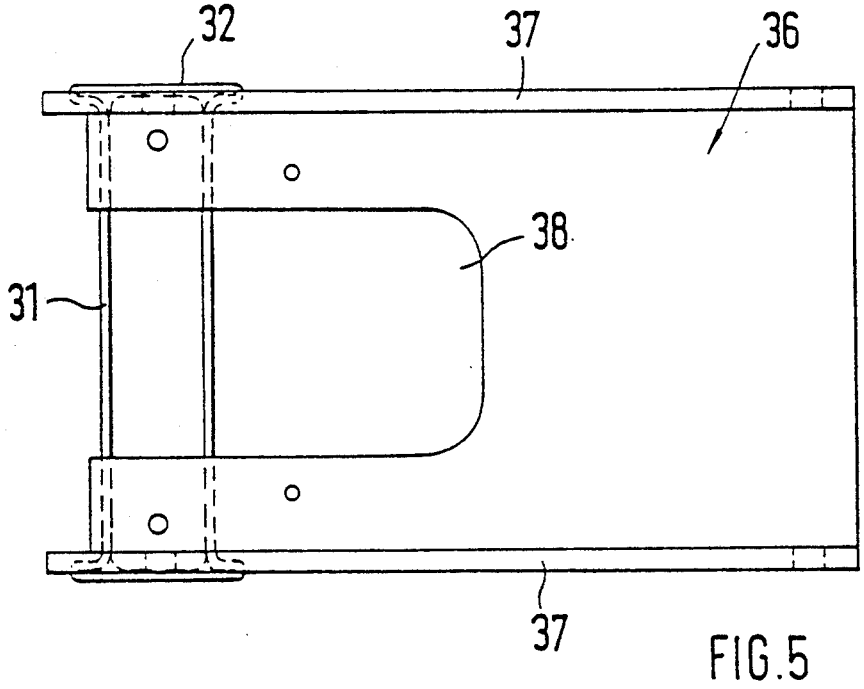
FIG. 5 is a top view of the unit in accordance with FIG. 4.

As shown in FIGS. 4 and 5, the connecting strap 36 can also be rigidly welded to the hollow section 31 of the table leg 30 and thus form a unit. The cross piece, such as the sheet metal section 20, is in this case inserted between the lateral legs 37 of the connecting strap 36 and is connected with them or with the center leg of the connecting strap 36. FIGS. 4 and 5 also show that the connecting strap 36 remains open in such a way, as shown by the cutout 38, that there is direct access from the hollow chamber of the table leg 30 to the cable channel 27 of the cross piece, if the basic leg of the sheet metal section 20 correspondingly remains open.

We claim:

1. In a table support for a work table or office desk having two lateral table legs, upper ends of the lateral table legs rigidly connected to each other with a plurality of connecting straps and a cross piece, lower ends of the lateral table legs having foot elements oriented towards a front and a back of the work table or office desk, the cross piece having a tub shape open towards a top of the cross piece and having side walls shaped as hollow sections, a horizontal cable channel cover for closing off the cross piece, and the cross piece accommodating additional attachable devices, the improvement comprising:

the cross piece with the side walls being a sheet metal section (20);

the connecting straps (36,) inserted into a corresponding receptacle at each end of the sheet metal section (20), the connecting straps (36) being connected with the sheet metal section (20) and the table legs (30); and an insertion connector (50) inserted into an end of the hollow sections of the side walls of the sheet metal section (20), said insertion connector (50) having a fastening receiver for attaching the additional attachable devices in a front portion of said insertion connector (50) and through a cutout section in the side walls of the sheet metal section (20).

2. In a table support in accordance with claim 1, wherein the hollow sections of the side walls of the sheet metal section (20) have a semi-hollow cylindrical cross section, and a plurality of base legs of the sheet metal section (20) merge into convexly curved exterior sections (21, 22) and then into a plurality of straight vertical interior sections (23, 24).

3. In a table support in accordance with claim 2, wherein the sheet metal section (20) is bent from a sheet metal blank, and the vertical interior sections (23, 24) each pass over into a horizontal fastening section rigidly connected with the base leg.

4. In a table support in accordance with claim 3, wherein passages of the convexly curved exterior sections (21, 22) merge into the straight vertical interior sections (23, 24) by way of a set-off horizontal connecting section (25, 26), and a plurality of bent, longitudinally directed spring pins (29) lockingly support and maintain the horizontal cable channel cover (28) in the connecting sections (25, 26).

5. In a table support in accordance with claim 4, wherein the horizontal cable channel cover (28) flushly closes off an open side of the sheet metal section (20).

6. In a table support in accordance with claim 4, wherein the horizontal cable channel cover (28) has a U-shaped cross section with a plurality of spreading side legs and at least one of the side legs forms an integral continuous gripping groove (29').

7. In a table support in accordance with claim 6, wherein the table legs (30) are shaped as hollow sections (31) each having an overall rectangular cross section, and the base legs of the sheet metal section (20) and the connecting straps (36) above the hollow sections (31) of the table legs (30) have cutouts (38).

8. In a table support in accordance with claim 7, wherein a first wall (32) of each narrow side of the hollow sections (31) extends beyond a second wall of each broad side of the hollow sections (31) and form a plurality of connecting bars (33, 34), and a vertical cable channel cover (35) is fixed between each of the connecting bars (33 or 34) of a wall of each of the broad sides.

9. In a table support in accordance with claim 8, wherein an insertion connector cross section of each said insertion connector (50) is adapted to a corresponding side wall cross section of each of the side walls in the shape of a hollow profile of each of the sheet metal sections (20) and has one of a continuous bore (51) and a threaded bore.

10. In a table support in accordance with claim 9, wherein each threaded bore is a threaded blind bore within the front portion of the insertion connector (50).

11. In a table support in accordance with claim 10, wherein the insertion connectors (50) are oriented towards the convexly curved exterior sections (21, 22) and are divided into a plurality of connecting bars (53) positioned through cutouts in a preset grid formation, and the additional attachable devices are connectable with the connecting bars (53) through the convexly curved exterior sections (21, 22).

12. In a table support in accordance with claim 11, wherein frontal sides of the cross piece (20) are covered with a plurality of closure elements (60).

13. In a table support in accordance with claim 12, wherein the cross piece (20) extends a predetermined distance beyond the table legs (30) which are in the form of the hollow sections (31).

14. In a table support in accordance with claim 1, wherein the sheet metal section (20) is bent from a sheet metal blank, and a plurality of vertical interior sections (23, 24) each pass over into a horizontal fastening section rigidly connected with a base leg of the sheet metal section (20).

15. In a table support in accordance with claim 1, wherein passages of convexly curved exterior sections (21, 22) of the sheet metal section (20) each merge into a straight vertical interior section (23, 24) by way of a setoff horizontal connecting section (25, 26), and a plurality of bent, longitudinally directed spring pins (29) lockingly support and maintain the horizontal cable channel cover (28) in the connecting sections (25, 26).

16. In a table support in accordance with claim 1, wherein the horizontal cable channel cover (28) flushly closes off an open side of the sheet metal section (20).

17. In a table support in accordance with claim 1, wherein the horizontal cable channel cover (28) has a U-shaped cross section with a plurality of spreading side legs and at least one of the side legs forms an integral continuous gripping groove (29').

18. In a table support in accordance with claim 1, wherein the table legs (30) are shaped as hollow sections (31) each having an overall rectangular cross section, and a plurality of base legs of the sheet metal section (20) and the connecting straps (36) above the hollow sections (31) of the table legs (30) have cutouts (38).

19. In a table support in accordance with claim 1, wherein an insertion connector cross section of each said insertion connector (50) is adapted to a corresponding side wall cross section of each of the side walls in the shape of a hollow profile of each of the sheet metal sections (20) and has one of a continuous bore (51) and a threaded bore.

20. In a table support in accordance with claim 1, wherein a plurality of insertion connectors (50) are oriented towards a plurality of corresponding convexly curved exterior sections (21, 22) of a base leg of the sheet metal section (20) and are divided into a plurality of connecting bars (53) positioned through cutouts in a preset grid formation, and the additional attachable devices are connectable with the connecting bars (53) through the convexly curved exterior sections (21, 22).

21. In a table support in accordance with claim 1, wherein frontal sides of the cross piece (20) are covered with a plurality of closure elements (60).

* * * * *